US011371315B2

(12) United States Patent
Stangeland

(10) Patent No.: US 11,371,315 B2
(45) Date of Patent: Jun. 28, 2022

(54) MILLING TOOL

(71) Applicant: Swarfix AS, Sandnes (NO)

(72) Inventor: Jan Stangeland, Sola (NO)

(73) Assignee: Swarfix AS, Sandnes (NO)

( * ) Notice: Subject to any disclaimer, the term of this patent is extended or adjusted under 35 U.S.C. 154(b) by 0 days.

(21) Appl. No.: 16/636,654

(22) PCT Filed: Aug. 2, 2018

(86) PCT No.: PCT/EP2018/070975
§ 371 (c)(1),
(2) Date: Feb. 5, 2020

(87) PCT Pub. No.: WO2019/042699
PCT Pub. Date: Mar. 7, 2019

(65) Prior Publication Data

US 2021/0148189 A1 May 20, 2021

(30) Foreign Application Priority Data

Sep. 1, 2017 (NO) ..... 20171418

(51) Int. Cl.
*E21B 29/00* (2006.01)
*E21B 33/13* (2006.01)

(52) U.S. Cl.
CPC ..... *E21B 33/13* (2013.01); *E21B 29/002* (2013.01)

(58) Field of Classification Search
CPC ..... E21B 33/13; E21B 29/002; E21B 29/007; E21B 37/02; E21B 27/04; E21B 29/00
See application file for complete search history.

(56) References Cited

U.S. PATENT DOCUMENTS 5,224,548 A * 7/1993 Dankovich, II ..... E21B 7/006 166/311
5,265,675 A 11/1993 Hearn et al.
(Continued)

FOREIGN PATENT DOCUMENTS

NO 338348 8/2016
WO 93/08374 4/1993
(Continued)

OTHER PUBLICATIONS

Norwegian Search Report dated Mar. 9, 2018, filed inter alia as statement of relevance for non-English ref cited therein, in particular NO338348 filed in IDS of Feb. 5, 2020 eidentified as background art. Note: WO 2016/155852 corrects a typo in the previous IDS, where the reference was identified as WO2016/155854.
(Continued)

*Primary Examiner* — Steven A MacDonald
(74) *Attorney, Agent, or Firm* — Andrus Intellectual Property Law, LLP

(57) ABSTRACT

The present invention provides a milling tool (1) for a wellbore, comprising a milling section (2) and a metal cuttings removal section (3), the milling section (2) comprises radially arranged milling elements (4); and the metal cuttings removal section (3) has a first end (5) and a second end (6) and comprises a cylinder-shaped magnetic element (7), a rotation generating device (8) and a helix-shaped longitudinal guide element (9), wherein the first end (5) is connected to the milling section; the helix-shaped longitudinal guide element (9) is arranged around the cylinder-shaped magnetic element (7); the rotation generating device (8) is operably connected to the cylinder-shaped magnetic element (7) or the helix-shaped longitudinal guide element (9); wherein the cylinder-shaped magnetic element and the helix-shaped longitudinal guide element (9) are rotatable relative to each other around a common centreline (C), and
(Continued)

configured such that metal cuttings accumulating on the cylinder-shaped magnetic element during use is guided by the helix-shaped longitudinal guide element towards the second end (6) of the metal cuttings removal section when the rotation generating device is operated.

14 Claims, 4 Drawing Sheets

(56) References Cited

U.S. PATENT DOCUMENTS

| | | | | |
|---|---|---|---|---|
| 6,302,666 | B1 | 10/2001 | Grupping | |
| 6,679,328 | B2 | 1/2004 | Hughes | |
| 6,695,058 | B1 * | 2/2004 | French | E21B 21/002 166/173 |
| 2002/0016265 | A1 | 11/2002 | Davis et al. | |
| 2004/0011528 | A1 * | 1/2004 | Howlett | E21B 17/046 166/311 |
| 2005/0274524 | A1 * | 12/2005 | Silguero | E21B 31/06 166/311 |
| 2008/0023033 | A1 * | 1/2008 | Potter | E21B 27/04 134/10 |
| 2011/0284210 | A1 * | 11/2011 | Hern | E21B 31/06 166/99 |
| 2014/0000900 | A1 * | 1/2014 | Leiper | E21B 17/04 166/311 |
| 2015/0129195 | A1 | 5/2015 | Laird et al. | |
| 2018/0016860 | A1 * | 1/2018 | Stangeland | E21B 27/04 |
| 2019/0112883 | A1 * | 4/2019 | McKenzie | B03C 1/284 |
| 2021/0148189 | A1 * | 5/2021 | Stangeland | E21B 37/02 |

FOREIGN PATENT DOCUMENTS

| | | |
|---|---|---|
| WO | 94/16198 | 7/1994 |
| WO | 95/03473 | 2/1995 |
| WO | 2010/120180 | 10/2010 |
| WO | 2015/112353 | 7/2015 |
| WO | 2016/108837 | 7/2016 |
| WO | 2016/155852 | 10/2016 |
| WO | 2016/155854 | 10/2016 |

OTHER PUBLICATIONS

Ringe, Thomas, "Section milling during plug and abandonment of petroleum wells", Faculty of Science and Technology, University of Stavanger.

* cited by examiner

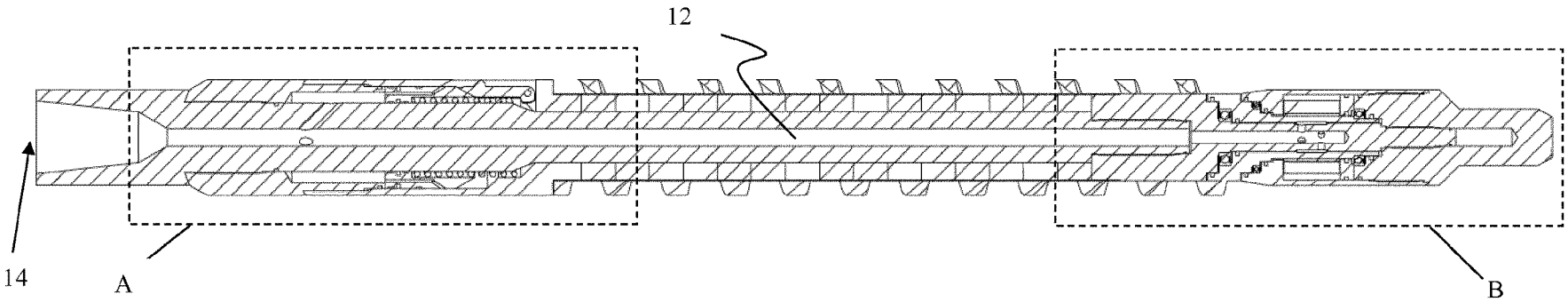
Fig. 2
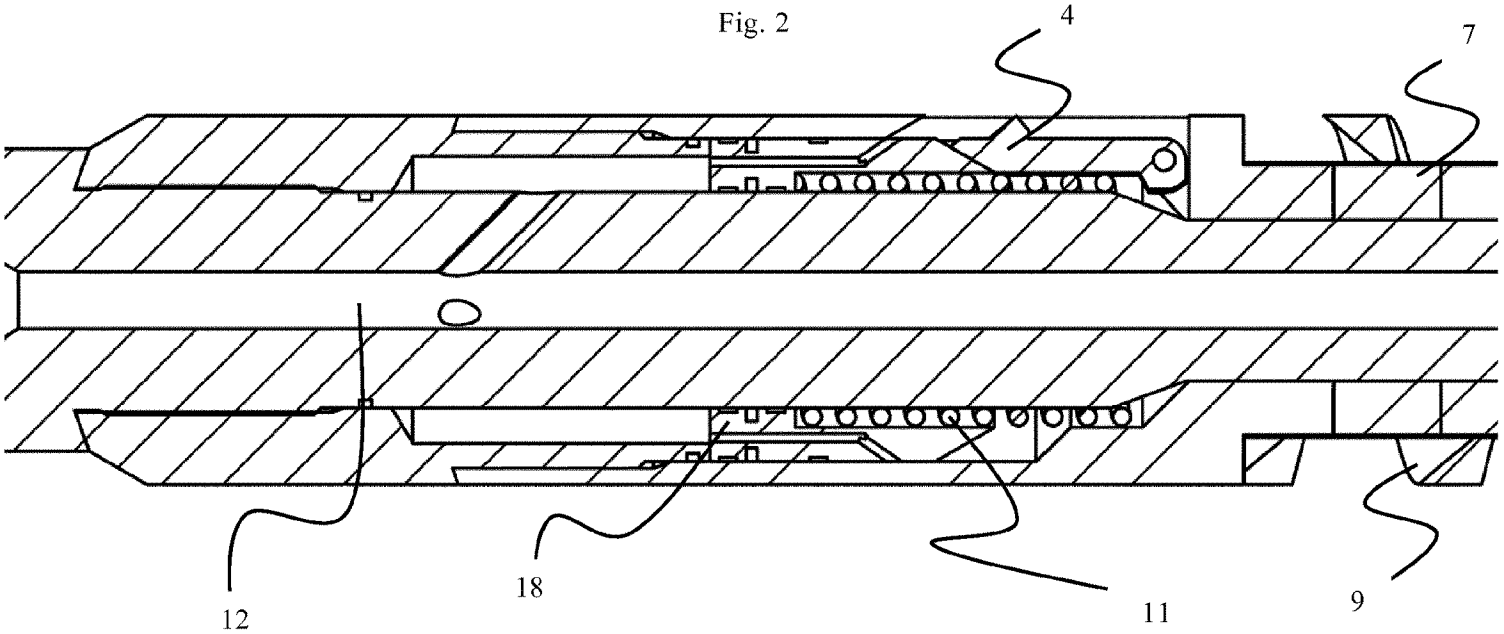
Fig. 3 (Section A)

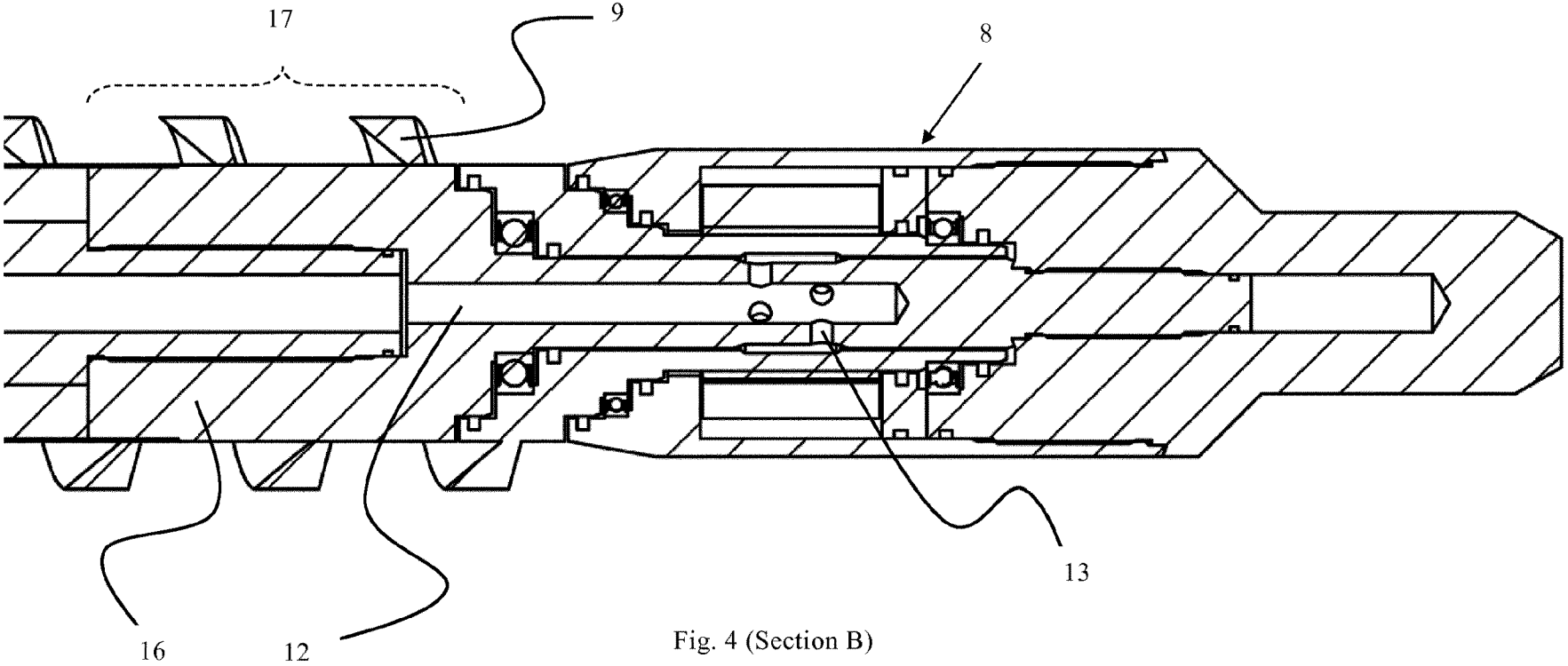
Fig. 4 (Section B)

MILLING TOOL

TECHNICAL FIELD

The present invention relates to the field of milling tools, and more specifically to a milling tool, and a method of using said milling tool.

BACKGROUND

Offshore oil and gas industry faces an increasing demand from governments and regulatory institutions to permanently seal/plug unproductive wells. Unproductive or abandoned wells which are not permanently plugged represent a large potential environmental threat.

In a common plugging and abandonment operation (P&A), a section of the well casing(s) in a wellbore is milled away and a cement plug is subsequently set at said section to permanently seal off the well. The milling operation produces large amounts of metal cuttings which may interfere with both the milling operation itself and the subsequent plug cementing operation. Contrary to most operations performed in preproduction and producing wells, P&A does not really require that the metal cuttings (often termed swarf) are removed from the wellbore after performing a milling/cutting operation, since a plugged and abandoned well does not contain any well equipment, such as a Blow-Out Preventer (BOP), that may be damaged by the presence of metal cuttings. The only requirement is that the metal cuttings are removed from the area of the well section in which the plug is set. This is to avoid that metal cuttings are present in the milled section, since the cuttings may compromise or interfere with the plug cementing operation causing improper sealing of the wellbore. Various P&A equipment and methods are comprehensively reviewed by Thomas Ringe in the thesis "*Section milling during plug and abandonment of petroleum wells*", Faculty of Science and Technology, University of Stavanger.

To avoid transporting the metal cuttings topside, various milling tools and methods have been proposed. Avoiding topside handling of such cuttings is highly advantageous since it is time-consuming/costly, requires additional handling equipment and provides a number of HSE issues. These prior art milling tools and methods have two features in common; the section milling is performed while moving the tool within the wellbore and the produced metal cuttings are deposited/transported by self-cleaning magnet technology further down in the wellbore.

U.S. Pat. No. 6,679,328 B2 discloses a milling tool for milling a section of casing. The milling is performed while pulling the milling tool in an upward direction by use of a hydraulic thrusting mechanism. The produced metal cuttings are moved downwards into the wellbore by use of a spiral auger.

WO 2010/120180 A1 discloses a milling tool for milling a section of casing. The milling is performed while pulling the milling tool in an upward direction presumably by use of a drill pipe. The produced metal cuttings are moved downwards into the wellbore by use of a fluid conduit and optionally a spiral auger.

The present invention provides a milling tool, wherein at least some of the disadvantages of the prior art is alleviated or avoided.

SUMMARY OF THE INVENTION

The present invention provides a milling tool for a wellbore as set out in the appended claims.

The rotation generating device can be connected to the helix-shaped longitudinal guide element.

The cylinder-shaped magnetic element can be rigidly connected to the milling section, such that the magnetic element co-rotates with the milling section. The helix-shaped longitudinal guide element can be made in a suitable non-magnetic material.

The milling section can be rotatable relative to the wellbore, preferably by a connected well string or drill pipe. Alternatively, the milling section can be rotated by a second rotation generating device, such as any suitable type of hydraulic or electric motor.

In one embodiment of the milling tool, the metal cuttings removal section can be configured such that metal cuttings accumulating on the cylinder-shaped magnetic element during use are pushed away from the milling tool, and preferably further down into the well bore. The metal cuttings removal section can be configured such that metal cuttings accumulating on the cylinder-shaped magnetic element during use is pushed away from the milling section.

In one embodiment of the milling tool, the milling section can comprise multiple nozzles for drilling mud, or drilling mud nozzles, the outlet of the nozzles being arranged such that metal cuttings formed/produced during a milling operation are guided towards the metal cuttings removal section during use. Preferably, the nozzles are arranged to eject drilling mud in the downwards direction of the well bore. The drilling mud flow from the nozzles can contribute to push the metal cuttings down into the wellbore. The multiple nozzles are preferably radially arranged at the circumference of the milling section.

In one embodiment, the milling tool can comprise a central passage, e.g. a fluid conduit along the centerline of the tool, for supply of drilling mud to the drilling mud nozzles, for moving the cutters into the activated position, and/or for driving the rotation generating device.

In one embodiment of the milling tool, an end section of the scrape, the end section being distal to the milling section, can be arranged around a cylinder-shaped non-magnetic element. The non-magnetic element can extend a distance from the magnetic element, the distance being sufficient to eliminate the magnetic attraction between the metal cuttings and the cylinder-shaped magnetic element.

In one embodiment of the milling tool, the radially arranged milling elements can be multiple radially arranged cutters. Preferably three to eight cutters. In one embodiment, the milling section can comprise a cylindrical housing in which the cutters are arranged. The cutters may be in a non-activated position, wherein the cutters are retracted in the housing or milling section, or an activated position, wherein the cutters are radially extended. In one embodiment, the cutters can be moved into the activated position by hydraulic pressure provided by drilling mud.

In one embodiment, the milling tool can be for use in plug and abandonment operations. Preferably, the milling tool is a section mill for milling a radial section of all casing strings in a plug and abandonment operation.

In use, the milling section can be arranged at a level above the metal cuttings removal section.

In one embodiment of the milling tool, the rotation generating device can be a hydraulic motor, preferably a drilling mud operated motor, or a centralizing anti-torque element. The drilling mud operated motor can preferably be a roller vane motor.

The centralizing anti-torque element can be connected to the helix-shaped longitudinal guide element and be able to interact with an inner surface of a wellbore, such that the helix-shaped longitudinal guide element is held substantially rotationally stationary relative the cylinder-shaped magnetic element when said magnetic element rotates along with the milling section.

In one embodiment of the milling tool, the rotation generating device can be a hydraulic or electric motor, preferably a drilling mud operated motor, arranged at the second end of the metal cuttings removal section and operatively connected to rotate the helix-shaped longitudinal guide element relative to the magnetic element.

In one embodiment of the milling tool, the milling section or the cuttings removal section can comprise a connecting end distal to the cuttings removal section or the milling section, respectively, the connecting end being suitable for connecting the tool to a wireline, a power cable, an umbilical, a well string, a drill pipe or a coiled tubing.

In one embodiment of the milling tool, the milling section can comprise a connecting end distal to the metal cuttings removal section, the connecting end being suitable for connecting the tool to a wireline, a power cable, an umbilical, a well string, a drill pipe or a coiled tubing.

In one embodiment, the method can comprise the steps of:

retrieving the milling tool topside; and performing the required operations to cementing a plug at the milled radial section.

The term "metal cuttings" is intended to mean any type of metal debris and particles, commonly termed "swarf" produced during a milling operation.

The term "milling elements" are intended to mean any type of edged milling feature arrangeable on a milling tool for grinding/cutting junk, casings etc. present in a wellbore.

SHORT DESCRIPTION OF THE DRAWINGS

The present invention is described in detail by reference to the following drawings:

FIG. 2 is a cross-sectional side view of the milling tool in FIG. 1.

FIG. 3 is an expanded cross-sectional view of the milling section of the milling tool in FIGS. 1 and 2.

FIG. 4 is an expanded cross-sectional view of the rotation generating device of the milling tool in FIGS. 1 and 2.

DETAILED DESCRIPTION OF THE INVENTION

A first embodiment of a milling tool according to the present invention is shown in FIGS. 1-4.

The inventive milling tool is particularly suitable for section milling in plug and abandonment operations (P&A). As opposed to the prior art milling tools, the milling tool according to the invention is able to perform milling while at the same time pushing/guiding produced metal cutting further down in the well bore. Further, the present milling tool avoids or alleviates the interference of produced metal cuttings with the milling itself, i.e. the metal cuttings are prevented from nesting/clogging the cutters.

Figure 1:
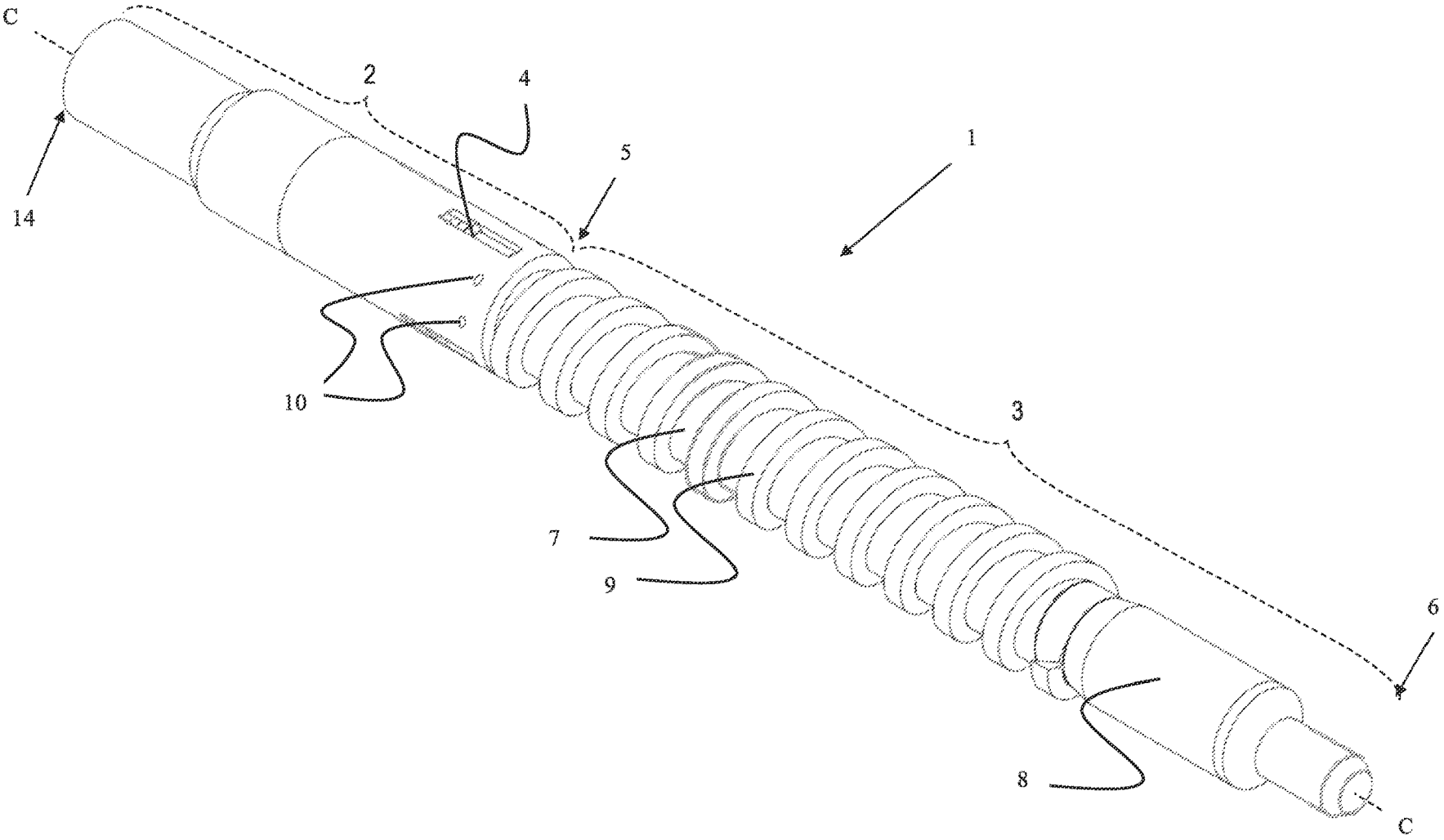
FIG. 1 is a perspective view of a first embodiment of a milling tool according to the invention.

The milling tool comprises a milling section 2 and a metal cuttings removal section 3. The milling section features four radially arranged cutters 4 (i.e. milling elements) suitable for milling a wellbore casing. The cutters may move between a passive and an active position. In the passive position, as shown in FIGS. 1-3, the cutters are retracted into the milling section. The cutters are pretensioned into the passive position by a spring 11, and upon activation by drilling mud pressure via the passage 12, a piston assembly 18 will push the cutters radially outwards into an active position, in which the cutters are in contact with a wellbore casing to be cut and milled. Various solutions for designing milling sections with retractable cutters, as well as the design of the cutters themselves, are well known to the skilled person and described in for instance WO 95/03473, U.S. Pat. No. 5,265,675A, US 2015/0129195 A1 and WO 2016/108837 A1.

The metal cuttings removal section 3 has a first end 5 and a second end 6 and comprises a cylinder-shaped magnetic element 7, a roller vane motor 8 (i.e. a rotation generating device) and a scraper 9 formed as a helix (i.e. a helix-shaped longitudinal guide element). The first end 5 is connected to the milling section. The scraper 9 is coaxially arranged around the cylinder-shaped magnetic element 7 and is operably connected to the roller vane motor 8. The roller vane motor 8 is driven by drilling mud entering the motor via the central longitudinal mud passage 12 and the mud inlets 13. Various roller vane motors suitable for use in a milling tool according to the invention are known and described in for instance WO 93/08374, WO 94/16198 and U.S. Pat. No. 6,302,666 B1. In addition to roller vane motors, any suitable type of hydraulic or electric motor may be used to rotate the scrape relative the magnetic element.

The magnetic element 7 and the scraper 9 are rotatable relative to each other around a common centreline C, and configured such that metal cuttings accumulating on the magnetic element during use are guided by the scraper towards the second end 6 of the metal cuttings removal section 3 when the roller vane motor 8 is operated. A part 17 of the scrape 9 being proximal the second end 6 is arranged around a cylinder-shaped non-magnetic element 16 of the metal cuttings removal section. The scraper 9 is preferably made in non-magnetic stainless steel, e.g. a suitable type of austenitic stainless steel.

The inner surface of the scrape (i.e. the surface turned towards the circumferential surface of the magnetic element) is slightly spaced (0.1-0.5 mm) from the circumferential surface. Further details, function and features of a suitable helix-shaped scrape and a corresponding magnetic element is disclosed in WO 2016/155852 A1.

The milling section 2 features a connecting end 14 distal from the metal cuttings removal section 3. The connecting end of the present embodiment is suitable for connecting the milling tool to a drill pipe (not shown). The drill pipe will provide the required rotation of the milling section 2, while at the same time providing mud to the roller vane motor 8 for rotating the scraper 9 relative the magnetic element 7, as well as a required hydraulic pressure for activation of the cutters 4. To aid in guiding the metal cuttings toward the magnetic element, the milling section features multiple mud nozzles 10. The outlets of the nozzles are arranged in a direction such that the produced metal cuttings are moved towards the metal cuttings removal section during use. The mud exiting the nozzles are also advantageous in that it contributes to a more effective milling by guiding the metal cutting away from the cutters.

Figure 5:
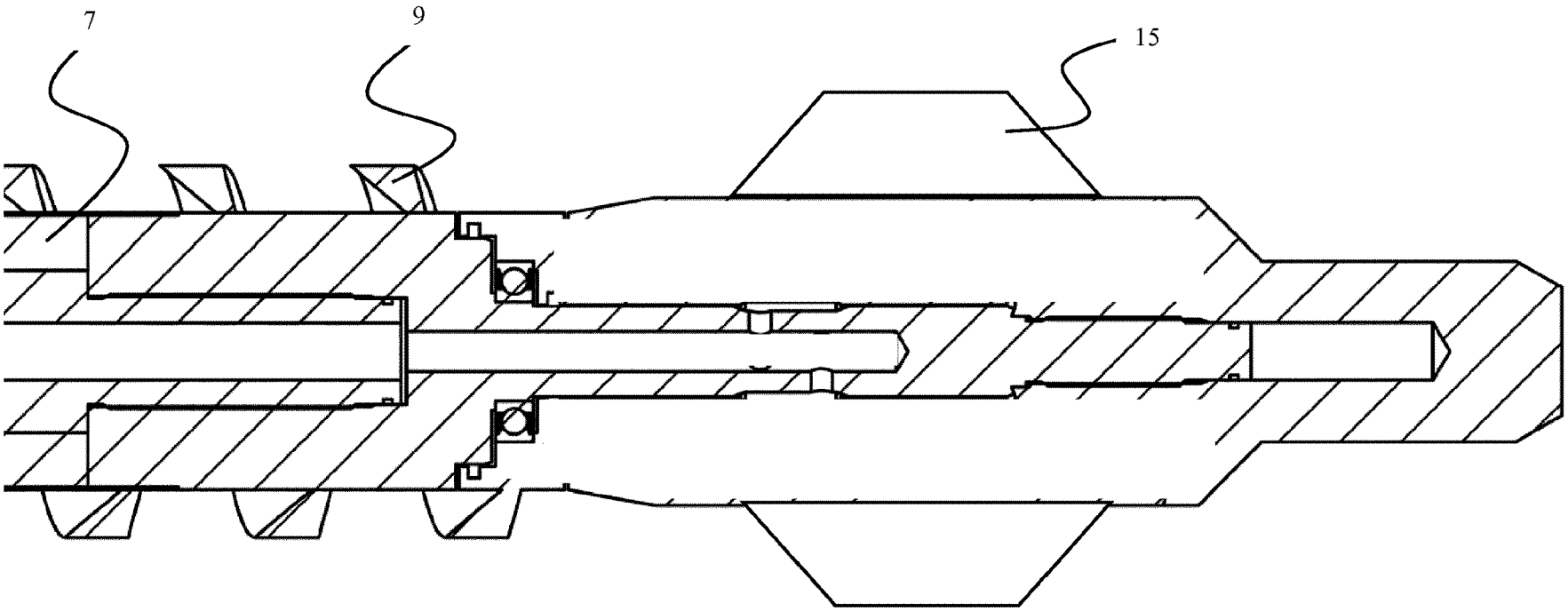
FIG. 5 is an expanded view of the rotation generating device of a second embodiment of the invention.

An exploded view of the metal cuttings removal section 3 of a second embodiment of a milling tool according to the invention is shown in FIG. 5. The second embodiment differs from the milling tool in FIGS. 1-4 in that the roller vane motor 8 is replaced by a centralizing anti-torque element 15 or anchor (i.e. an alternative rotation generating device) connected to the scraper 9. During milling, the anti-torque element 15 is radially extended to provide an adequate frictional contact with the inner surface of the wellbore/casing, such that the scraper 9 obtains a rotational movement relative to the magnetic element 7. The anti-torque element is only shown schematically, however detailed designs of suitable anti-torque elements would be obvious to the skilled person based on the present disclosure and the prior art. The anti-torque element 15 may for instance be similar to the anti-torque anchor devices disclosed in U.S. Pat. No. 6,679,328 B2 or the gripper mechanism disclosed in WO 2015/112353 A1. The centralizing anti-torque element 15 may for instance comprise radially extendable sections which are hydraulically activated by drilling mud via the central longitudinal mud passage 12.

The milling tool according to the present invention is described in detail by reference to embodiments particularly suitable for section milling in connection with P&A operations, wherein the cuttings removal section is arranged to guide/push the produced metal cuttings further down into the wellbore. However, the main features of the inventive milling tool, i.e. the combination of the milling section 2 and the metal cuttings removal section 3 will provide an advantageous effect in a number of different milling tools having different types of milling elements (including both retractable cutters and fixed cutters/blades), such as top mills, taper mills, junk mills etc. since the produced metal cuttings, and any other metal debris, are efficiently guided away from the milling section. This effect contributes to avoid clogging of metal debris at the site of milling and also to lower the wear of the milling elements. The advantageous effect is further increased by the feature of having nozzles 10 providing a drilling mud flow guiding the metal cuttings/debris away from the milling elements and towards the metal cuttings removal section.

The invention claimed is:

1. A milling tool for a wellbore, the milling tool comprising a milling section and a metal cuttings removal section, the milling section comprising radially arranged milling elements; and the metal cuttings removal section having a first end and a second end and comprising a cylinder-shaped magnetic element, a rotation generating device, and a helix-shaped longitudinal guide element, wherein:

the first end is coupled to the milling section;

the helix-shaped longitudinal guide element is arranged around the cylinder-shaped magnetic element; and the rotation generating device is operably coupled to the cylinder-shaped magnetic element or the helix-shaped longitudinal guide element; and wherein the one of the cylinder-shaped magnetic element and the helix-shaped longitudinal guide element is rotatable relative to the other around a common centreline, and configured such that metal cuttings accumulating on the cylinder-shaped magnetic element during use are guided by the helix-shaped longitudinal guide element towards the second end of the metal cuttings removal section when the rotation generating device is operated.

2. The A milling tool according to claim 1, wherein the metal cuttings removal section is configured such that metal cuttings accumulating on the cylinder-shaped magnetic element, during use, are pushed away from the milling tool.

3. The milling tool according to claim 1, wherein the milling section comprises multiple nozzles for drilling mud, the outlets of the nozzles are arranged such that metal cuttings are guided towards the metal cuttings removal section during use.

4. The milling tool according to claim 1, wherein an end section of the helix-shaped longitudinal guide element, the end section being distal to the milling section, is arranged around a cylinder-shaped non-magnetic element.

5. The milling tool according to claim 1, wherein the radially arranged milling elements are multiple radially arranged cutters.

6. The milling tool according to claim 1, wherein the rotation generating device is a hydraulic motor, preferably a drilling mud operated motor, or a centralizing anti-torque element.

7. The milling tool according to claim 1, wherein the rotation generating device is a drilling mud operated motor arranged at the second end of the metal cuttings removal section and connected to rotate the helix-shaped longitudinal guide element relative to the magnetic element.

8. The milling tool according to claim 1, wherein the milling section or the cuttings removal section comprises a connecting end distal to the cuttings removal section or the milling section, respectively, the connecting end being suitable for connecting the milling tool to a wireline, a power cable, an umbilical, a well string, a drill pipe or a coiled tubing.

9. A method of plugging and abandoning a well bore, the method comprising the steps of:

lowering a milling tool into the well-bore, the milling tool comprising a milling section and a metal cuttings removal section, the milling section comprising radially arranged milling elements; and the metal cuttings removal section having a first end and a second end and comprising a cylinder-shaped magnetic element, a rotation generating device, and a helix-shaped longitudinal guide element, wherein: the first end is coupled to the milling section; the helix-shaped longitudinal guide element is arranged around the cylinder-shaped magnetic element; and the rotation generating device is operably coupled to the cylinder-shaped magnetic element or the helix-shaped longitudinal guide element; and wherein the one of the cylinder-shaped magnetic element and the helix-shaped longitudinal guide element is rotatable relative to the other around a common centreline, and configured such that metal cuttings accumulating on the cylinder-shaped magnetic element during use are guided by the helix-shaped longitudinal guide element towards the second end of the metal cuttings removal section when the rotation generating device is operated; and milling a radial section through all the casing strings present in the well bore during movement of the milling tool, while simultaneously pushing metal cuttings from the milling away from the milling tool and further down into the well-bore.

10. The method according to claim 9, further comprising the steps of:

retrieving the milling tool topside; and performing the required operations to cement a plug at the milled radial section.

11. A metal cuttings removal section having first and second ends and being configured to be coupled via the first end to a milling section of a milling tool for a wellbore, the metal cuttings removal section comprising:

a cylinder-shaped magnetic element, a rotation generating device, and a helix-shaped longitudinal guide element, wherein:

the helix-shaped longitudinal guide element is arranged around the cylinder-shaped magnetic element; and the rotation generating device is operably connected to the cylinder-shaped magnetic element or the helix-shaped longitudinal guide element; and wherein the one of the cylinder-shaped magnetic element and the helix-shaped longitudinal guide element is rotatable relative to the other around a common centreline, and are configured such that metal cuttings accumulating on the cylinder-shaped magnetic element during use are guided by the helix-shaped longitudinal guide element towards the second end of the metal cuttings removal section when the rotation generating device is operated.

12. The metal cuttings removal section according to claim 11, being configured such that the metal cuttings accumulating on the cylinder-shaped magnetic element, during use, are pushed away from the milling tool.

13. The metal cuttings removal section according to claim 12, wherein an end section of the helix-shaped longitudinal guide element is arranged around a cylinder-shaped non-magnetic element, the end section being distal to the milling section when the metal cuttings removal section is coupled to the milling section in use.

14. The metal cuttings removal section according to claim 11, wherein an end section of the helix-shaped longitudinal guide element is arranged around a cylinder-shaped non-magnetic element, the end section being distal to the milling section when the metal cuttings removal section is coupled to the milling section in use.

* * * * *